United States Patent [19]

Lindberg et al.

[11] Patent Number: 4,496,023

[45] Date of Patent: Jan. 29, 1985

[54] PNEUMATICALLY OPERATED IMPACT TOOL

[75] Inventors: Eric T. Lindberg, Bromma; Anna M. Friedman, Älta, both of Sweden

[73] Assignee: Atlas Copco Aktiebolag, Nacka, Sweden

[21] Appl. No.: 531,603

[22] Filed: Sep. 12, 1983

[30] Foreign Application Priority Data

Sep. 16, 1982 [SE] Sweden ..... 8205318

[51] Int. Cl.[3] ..... F01N 1/08

[52] U.S. Cl. ..... 181/230; 181/238; 181/255; 173/DIG. 2

[58] Field of Search ..... 173/134, 168, DIG. 2; 181/230, 240, 249, 251, 238, 255

[56] References Cited

U.S. PATENT DOCUMENTS

| | | | |
|---|---|---|---|
| 3,635,299 | 1/1972 | Hayes | 173/DIG. 2 |
| 3,815,705 | 6/1974 | Bennett | 181/230 |
| 3,995,712 | 12/1976 | Leistritz et al. | 181/230 |
| 4,294,330 | 10/1981 | Baldwin et al. | 181/230 |
| 4,461,204 | 7/1984 | Emonet | 173/DIG. 2 |

*Primary Examiner*—Frank T. Yost
*Assistant Examiner*—Hien H. Phan
*Attorney, Agent, or Firm*—Frishauf, Holtz, Goodman & Woodward

[57] ABSTRACT

A plastic silencer (12) surrounds a compressed air tool (11) and forms an exhaust chamber (27) around the tool. Two exhaust tubes (31, 32) from the chamber (27) are to the greater part situated in the chamber. A number of holes (35, 36) have been drilled near the inlet ends of the tubes. As a result the building up of ice in the inlet is prevented.

1 Claim, 3 Drawing Figures

PNEUMATICALLY OPERATED IMPACT TOOL

BACKGROUND OF THE INVENTION

This invention relates to a pneumatically operated impact tool in which a pneumatically actuated hammer piston is reciprocable in a cylinder to repeatedly impact upon an anvil and an exhaust chamber is arranged to receive the exhaust air from the cylinder, said exhaust chamber having at least one outlet tube that has its inlet end inside said exhaust chamber.

SUMMARY OF THE INVENTION

In such a tool, the outlet tubes are tuned to dampen the sound frequency that is most disturbing. Ice builds up in the inlet of the tubes and forms restrictions for the exhaust air, which reduces the efficiency and power of the tool. It is an object of the invention to prevent ice from building up in the exhaust tubes.

BRIEF DESCRIPTION OF THE DRAWINGS

The invention will be described with reference to the drawings, which show an embodiment of the invention.

DESCRIPTION OF THE PREFERRED EMBODIMENT

Figure 1:
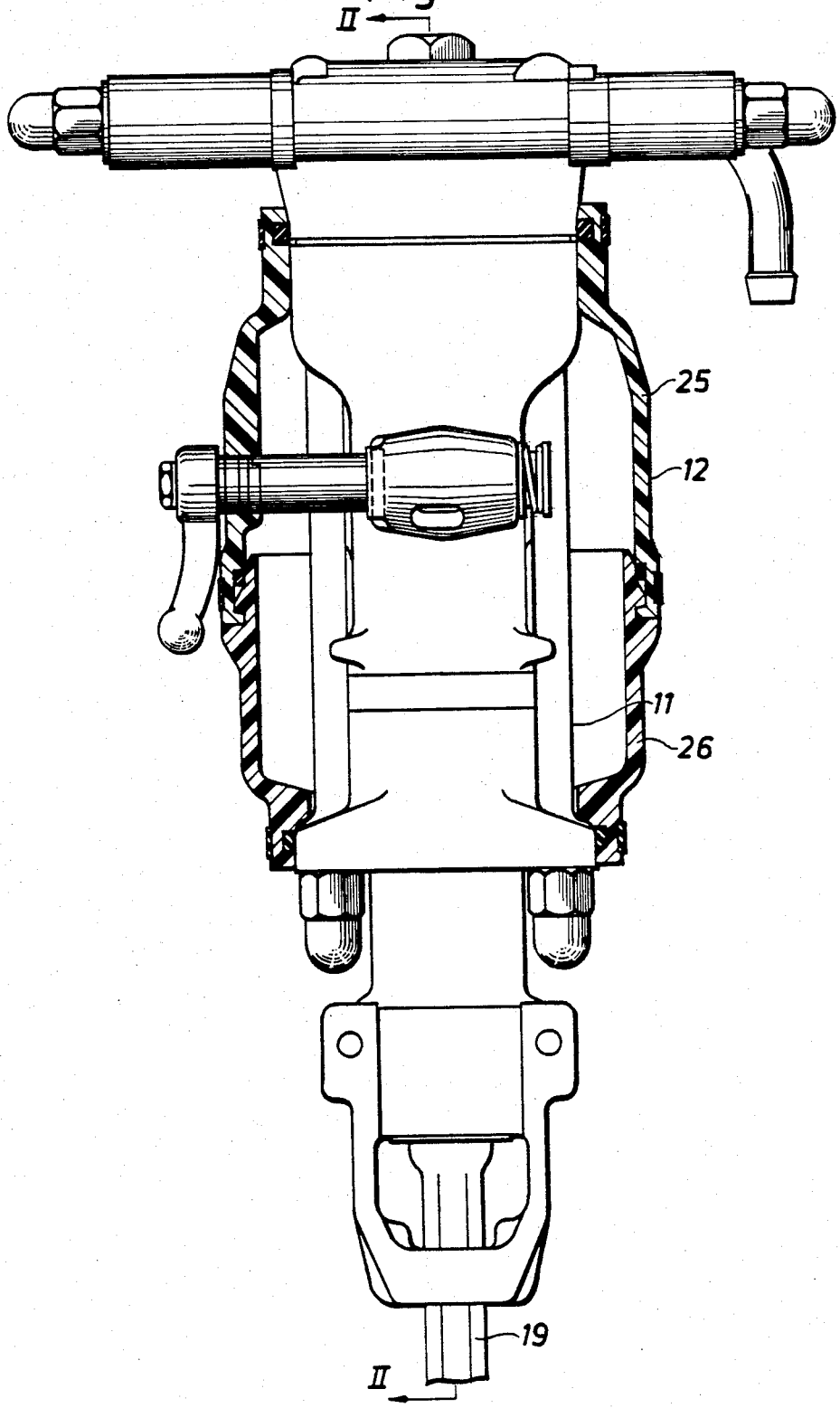
FIG. 1 is a longitudinal view of a rock drill.
Figure 2:
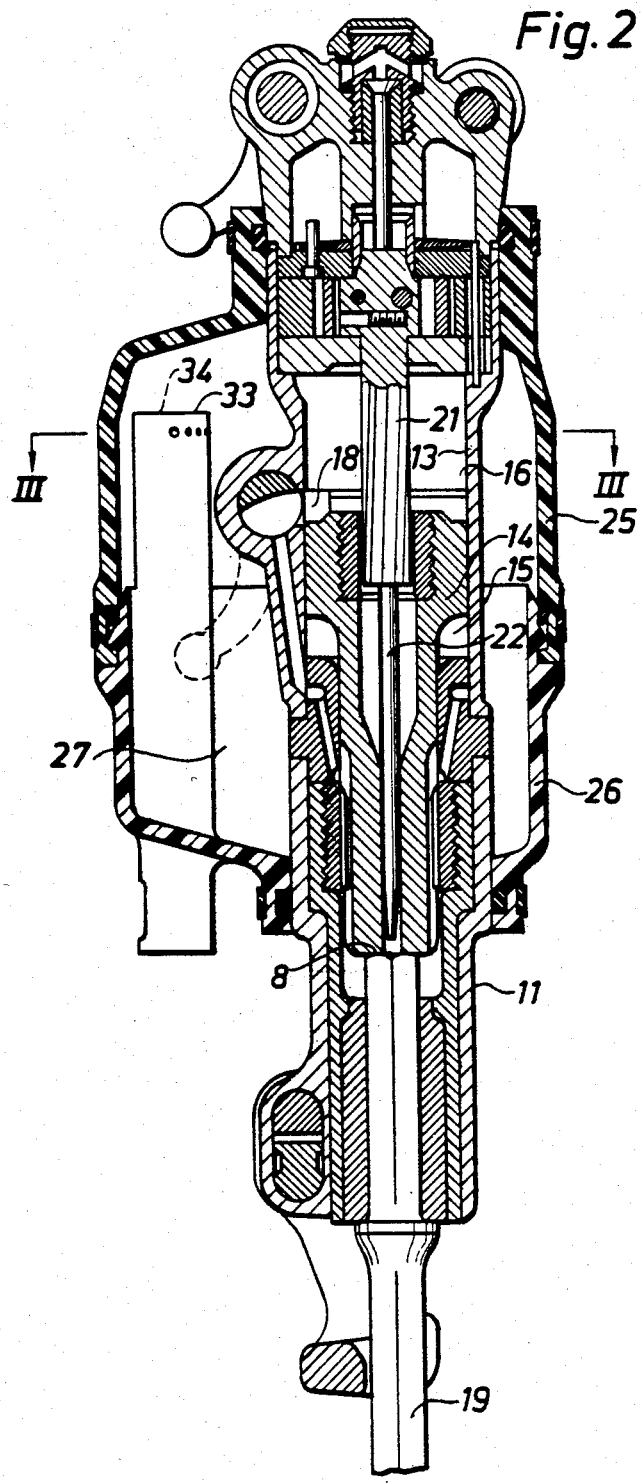
FIG. 2 is a longitudinal section of the rock drill.
Figure 3:
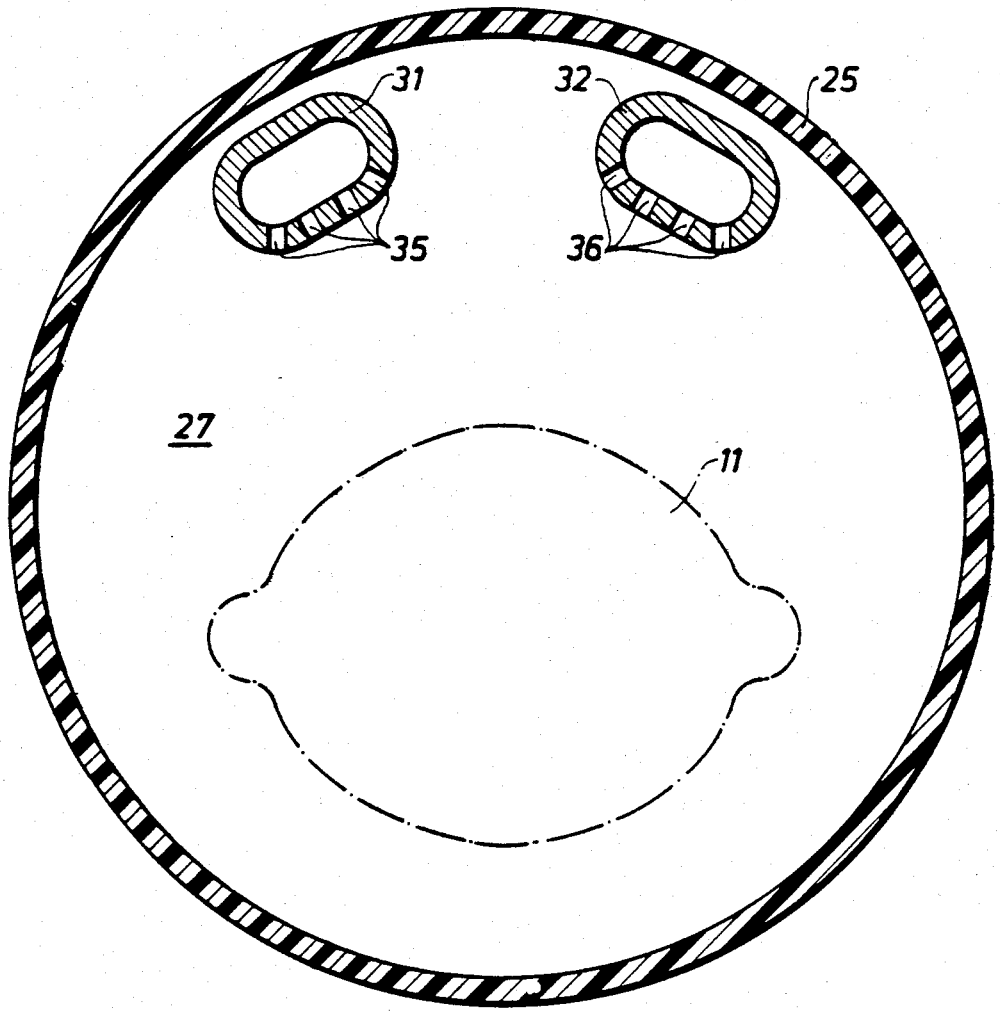
FIG. 3 is a section taken along line 3—3 in FIG. 2.

The pneumatic impact tool in the form of a hand-held rock drill shown in the figures has a steel housing 11 on which an exhaust silencer 12 made of a plastic material is mounted.

Inside the housing 11, a cylinder 13 is formed in which a hammer piston 14 is reciprocably driven by the alternating pressurization of two cylinder chambers 15, 16. The two cylinder chambers 15, 16 exhaust alternatively through a common exhaust port 18. When reciprocating, the hammer piston 14 impacts repeatedly on the anvil surface 8 of a tool in the form of a drill steel 19.

During its return stroke, the hammer piston 14 is forced to rotate by means of a rifle bar 21 and it transmits its rotation to the drill steel 19. Flush air is supplied to the drill steel 19 through a tube 22. The operation and the design of the rock drill are conventional and are therefore not described in more detail.

Two exhaust tubes 31, 32 are integral parts of the lower part 26 of the silencer 12 and they extend upwardly into the upper part 25 of the silencer 12 with a clearance to the wall of the upper part 25.

Near the inlets 33, 34 of the exhaust tubes 31, 32, there are four holes 35 and 36 respectively in each tube 31, 32 so that the exhaust air in the exhaust chamber 27 will enter the tubes both through their inlets 33, 34 and the holes 35, 36. The total area of the holes 35, 36 of a tube 31 or 32 is small as compared to the area of the inlet 33 or 34 of the tube; the area ratio is smaller than 1:5 or even smaller than 1:10. The holes 35, 36 are located 10 mm or less from the inlet ends of the tubes.

The holes 35, 36 are shown as bores through the walls of the tubes but they can also be in the form of slots that extend axially from the inlet edges.

The holes prevent ice from building up at the inlets of the tubes. Such ice would form restrictions which would increase the pressure in the exhaust chamber 27 and reduce the power and efficiency of the impact tool.

We claim:

1. Pneumatically operated impact tool in which a pneumatically actuated hammer piston (14) is reciprocable in a cylinder (13) to repeatedly impact upon an anvil (8) and an exhaust chamber (27) is arranged to receive the exhaust air from the cylinder, said exhaust chamber having at least one outlet tube (31,32) that has its inlet end inside said exhaust chamber, characterized by a number of holes (35, 36) through the tube (31, 32) adjacent the inlet end thereof so that air will flow from the exhaust chamber (27) to the tube (31, 32) both through the inlet of the tube and through said holes which hava a small total area as compared to the area of the inlet of the tube.

* * * * *